US012349783B1

(12) United States Patent
He

(10) Patent No.: US 12,349,783 B1
(45) Date of Patent: Jul. 8, 2025

(54) FORWARD AND REVERSE CLEANING BRUSH WITH WATER SPRAYING FUNCTION

(71) Applicant: Shenzhen Youmeile Electronic Technology Co., Ltd., Guangdong (CN)

(72) Inventor: Bing He, Guangdong (CN)

( * ) Notice: Subject to any disclaimer, the term of this patent is extended or adjusted under 35 U.S.C. 154(b) by 0 days.

(21) Appl. No.: 18/974,181

(22) Filed: Dec. 9, 2024

(51) Int. Cl.
*A46B 13/04* (2006.01)
*A46B 13/00* (2006.01)
*A46B 15/00* (2006.01)

(52) U.S. Cl.
CPC ..... *A46B 13/04* (2013.01); *A46B 13/008* (2013.01); *A46B 15/003* (2013.01); *A46B 2200/3033* (2013.01)

(58) Field of Classification Search
CPC ..... A46B 13/04; A46B 13/008; A46B 15/003; A46B 2200/3033; A46B 13/001; A46B 13/003; A46B 15/0016; A46B 13/00
USPC ..... 401/270, 282
See application file for complete search history.

(56) References Cited

U.S. PATENT DOCUMENTS

| | | | | |
|---|---|---|---|---|
| 9,032,576 | B2 * | 5/2015 | Zelickson | A46B 13/04 15/22.1 |
| 10,022,025 | B2 * | 7/2018 | Powell | A46B 13/008 |
| 2017/0150851 | A1 * | 6/2017 | Sueyoshi | A46B 9/06 |

* cited by examiner

*Primary Examiner* — David J Walczak

(57) ABSTRACT

A forward and reverse cleaning brush with water spraying function, comprising a shell, a water spraying heating mechanism, a power mechanism, a transmission component and a cleaning brush disc, wherein the water spraying heating mechanism is arranged in the shell, the power mechanism is arranged in the shell, the transmission component is arranged at the front end of the shell, and the front end of the transmission component extends out of the shell, the cleaning brush disc is detachably arranged at the front end of the transmission component, the power mechanism and the transmission component cooperate to drive the cleaning brush disc to rotate.

8 Claims, 12 Drawing Sheets

FORWARD AND REVERSE CLEANING BRUSH WITH WATER SPRAYING FUNCTION

FIELD OF THE INVENTION

The present application relates to the technical field of household appliances. More specifically, the present application relates to forward and reverse cleaning brush with water spraying function.

BACKGROUND

In daily life, people often use brushes to scrub various objects, which can make the cleaning process faster and more effective. However, traditional brushes are typically manually operated, requiring users to hold the brush and move it back and forth quickly across the surface. Prolonged use of these brushes can lead to hand fatigue, making them inconvenient for extended cleaning tasks.

To address this issue, electric cleaning brushes have emerged on the market. For example, patent number CN202420602001.2 describes an electric cleaning brush that includes a motor, an inner wheel brush head driven by the motor, and an outer wheel brush head that fits over the inner wheel brush head. The outer brush head is also powered by the motor's output shaft. A transmission assembly connects one of the brush heads to the motor's output shaft, allowing the inner and outer brush heads to rotate in opposite directions. This design enables the motor to do the work of brushing, reducing the need for back-and-forth hand movements, which in turn eases strain on the hands.

Despite these advancements, existing electric cleaning brushes still face challenges. Most cleaning tasks require spraying water onto the area being cleaned before using the electric brush, which often necessitates manual water spraying to minimize dust—this can be cumbersome.

Therefore, there is a need to develop a forward and reverse cleaning brush that incorporates a built-in water spraying function to address these issues more efficiently.

SUMMARY

The technical problem to be solved by the present invention is to overcome the defects of the above-mentioned technology and provide a forward and reverse cleaning brush with water spraying function.

The technical problem to be solved by the present invention is to overcome the defects of the above-mentioned technology and provide a forward and reverse cleaning brush with water spraying function, comprising a shell, a water spray heating mechanism, a power mechanism, a transmission component and a cleaning brush plate, wherein the water spray heating mechanism is arranged in the shell, the power mechanism is arranged in the shell, the transmission component is arranged at the front end of the shell, and the front end of the transmission component extends out of the shell, the cleaning brush plate is detachably arranged at the front end of the transmission component, the power mechanism and the transmission component cooperate to drive the cleaning brush plate to rotate, a first water outlet hole penetrating the cleaning brush plate is arranged in the middle part of the cleaning brush plate, one end of the water spray heating mechanism passes through the transmission component and extends to the first water outlet hole, a second water outlet hole is arranged at the front end of the shell, one end of the water spray heating mechanism passes through the transmission component and the power mechanism and extends to the first water outlet hole and the second water outlet hole respectively.

which also comprising a control system disposed in the shell;

wherein the transmission component includes a hollow inner rotating shaft, a hollow outer rotating shaft, a first driven gear, a second driven gear and a transmission gear; wherein a bearing is provided in the hollow outer rotating shaft, and the hollow inner rotating shaft is arranged in the bearing; the hollow inner rotating shaft and the hollow outer rotating shaft are both connected and cooperated with the cleaning brush plate; the hollow outer rotating shaft is extended from the rear end of the hollow inner rotating shaft, and the first driven gear is provided at one end extending from the hollow outer rotating shaft; wherein the second driven gear is provided at the rear end of the hollow outer rotating shaft; the transmission gear is rotatably arranged in the outer shell, and the transmission gear is meshed with the first driven gear; the power mechanism is respectively meshed with the second driven gear and the transmission gear to drive the hollow inner rotating shaft and the hollow outer rotating shaft to rotate in different directions;

wherein one end of the water spray heating mechanism passes through the hollow inner rotating shaft and the power mechanism and then extends to the first water outlet and the second water outlet.

Wherein the shell comprises a front shell, a rear shell, a tail cover and a mounting frame, wherein the rear end of the front shell and the front end of the rear shell are connected by bolts, the rear end of the rear shell and the tail cover are connected by bolts, the mounting frame is arranged in the front shell and connected to the front shell and the rear shell by bolts, the second water outlet is arranged at the front end of the front shell, and a chamber is arranged at the upper end of the rear shell.

The forward and reverse cleaning brush with water spraying function of claim 2, wherein the power mechanism includes a servo motor and a double-layer driving gear; the servo motor is arranged on a mounting frame; a double-layer driving gear is arranged on the rotating shaft of the servo motor; the lower gear of the double-layer driving gear is meshed with the second driven gear; wherein the upper gear of the double-layer driving gear cooperates with the transmission gear to drive the hollow inner rotating shaft and the hollow outer rotating shaft to rotate in different directions; a through hole is arranged in the rotating shaft of the servo motor; wherein the bearings are arranged at both ends of the through hole; one end of the water spray heating mechanism passes through the through hole and extends to the second water outlet.

The control system includes a control panel and buttons; the control panel is connected to the tail cover by bolts; the tail cover is provided with buttons that match the control panel.

The cleaning brush plate comprises a cleaning brush chassis, an inner brush plate, an outer brush plate and a brush plate chassis, the front end of the front shell is provided with a cleaning brush chassis, the middle part of the cleaning brush chassis is provided with a bearing, the hollow outer rotating shaft is arranged in the bearing, the brush plate chassis is located below the cleaning brush chassis, the upper end of the brush plate chassis is connected with the bottom of the hollow outer rotating shaft, the outer brush plate is snap-connected with the brush plate chassis, the upper end of the inner brush plate passes through the brush plate chassis and is connected with the hollow inner rotating shaft, a bearing is arranged inside the lower end of the brush plate chassis, and the lower end of the inner brush plate is arranged in the bearing.

The cleaning brush chassis is provided with a cylinder, and the transmission gear is rotatably arranged on the cylinder;

The lower end of the inner brush plate is arranged in a circular shape, the lower end of the outer brush plate is arranged in a ring shape, and the lower end of the inner brush plate is arranged at the center of the lower end of the outer brush plate;

The first water outlet is arranged in the middle of the inner brush plate

The water spray heating mechanism includes a water storage tank, a water pump, a micro-electric heater, a water spray pipe, and a water delivery pipe; the water storage tank is arranged in the chamber; the rear shell is provided with a hole connected to the front shell; the water storage tank is supplied with a drain pipe, one end of the drain pipe extends from the hole into the front shell; wherein the water pump is arranged in the front shell and is installed on the rear shell by bolts; a pipeline connects the drain pipe to the water pump's inlet; the micro-electric heater is installed below the mounting frame by bolts; the water outlet of the water pump is connected to the water inlet of the micro-electric heater through a pipeline; the water spray pipe is arranged in the hollow inner rotating shaft, and the front end of the water spray pipe is located in the first water outlet hole; the water outlet of the micro electric heater is provided with a tee, two of the pipe openings of the tee are provided with hoses, the rear end of the water spray pipe is connected to one of the hoses, the water delivery pipe is arranged in the through hole and placed in the bearing, the rear end of the water delivery pipe is connected to the other hose, the other end of the water delivery pipe is provided with a pipe body, and the other end of the pipe body extends to the second water outlet hole.

The end of the water spray pipe located in the first water outlet is provided with a sealing ring, the end of the pipe body located in the second water outlet is provided with a sealing ring, the front end of the mounting frame is provided with a limiting groove, the tail of the water spray pipe is located in the limiting groove, which is used to limit the rotation of the water spray pipe, the middle part and the rear end of the hollow inner rotating shaft are both provided with bearings, and the water spray pipe is placed in the bearing.

The water tank is provided with a water adding pipe at the rear end, the rear shell is provided with a water adding hole at the rear end, the water adding pipe is placed at the water adding hole, and a sealing cover is provided on the water adding pipe.

The advantages of the present invention compared with the prior art are:

1. A water spray heating mechanism is integrated into the cleaning process. The water spray pipe of this mechanism is positioned at the first water outlet located in the center of the inner brush plate. This design allows water to be sprayed while the cleaning brush is in use, effectively reducing dust without the need to spray water beforehand. This feature enhances convenience, streamlines the cleaning steps, and improves overall cleaning efficiency. Additionally, the cleaning brush is equipped with a water heating function, enabling it to spray hot water or steam. This capability assists in sterilizing the objects being cleaned to some extent. Furthermore, detergent can be added to the water storage tank, allowing for the detergent to be sprayed along with the water.

2. The design of the transmission component allows the water spray pipe to be routed through the hollow inner rotating shaft. This configuration ensures that the water spray from the pipe remains effective even while the shaft is rotating. Additionally, this design reduces the overall size of the forward and reverse cleaning brush with a water spraying function, making it more convenient to use in confined spaces.

3. The servo motor drives the transmission components. Through the conversion of the transmission components, the inner brush plate and the outer brush plate can rotate in different directions, to adapt to different cleaning needs and obtain better cleaning effects.

BRIEF DESCRIPTION OF THE DRAWINGS

As shown in FIGS. 1-12:

1. First water outlet hole,
2. Hollow inner rotating shaft,
3. Hollow outer rotating shaft,
4. First driven gear,
5. Second driven gear,
6. Transmission gear,
7. Front shell,
8. Rear shell,
9. Tail cover,
10. Mounting frame,
11. Chamber,
12. Servo motor,
13. Double-layer driving gear,
14. Control panel,
15. Button,
16. Cleaning brush chassis,
17. Inner Brush plate,
18. outer brush plate,
19. brush plate chassis,

20. cylinder,
21. water storage tank,
22. water pump,
23. micro electric heater,
24. water spray pipe,
25. hole,
26. drain pipe,
27. limit groove,
28. water supply pipe,
29. water supply hole,
30. sealing cover,
31. second water outlet hole,
32. through hole,
33. water delivery pipe,
34. pipe body While the technology is susceptible to various modifications and alternative forms, specifics thereof have been shown by way of example and drawings, and will be described in detail. It should be understood, however, that the application is not limited to the particular embodiments described. On the contrary, the application is to cover modifications, equivalents, and alternatives falling within the spirit and scope of the technology.

DETAILED DESCRIPTION OF EMBODIMENTS

The embodiments of the present technology described herein are not intended to be exhaustive or to limit the technology to the precise forms platelosed in the following detailed description. Rather, the embodiments are chosen and described so that others skilled in the art can appreciate and understand the principles and practices of the present technology.

All publications and patents mentioned herein are hereby incorporated by reference. The publications and patents platelosed herein are provided solely for their platelosure. Nothing herein is to be construed as an admission that the inventors are not entitled to antedate any publication and/or patent, including any publication and/or patent cited herein.

The following is a further detailed description of a forward and reverse cleaning brush with water spraying function according to the present invention in conjunction with the accompanying drawings.

Figure 1:
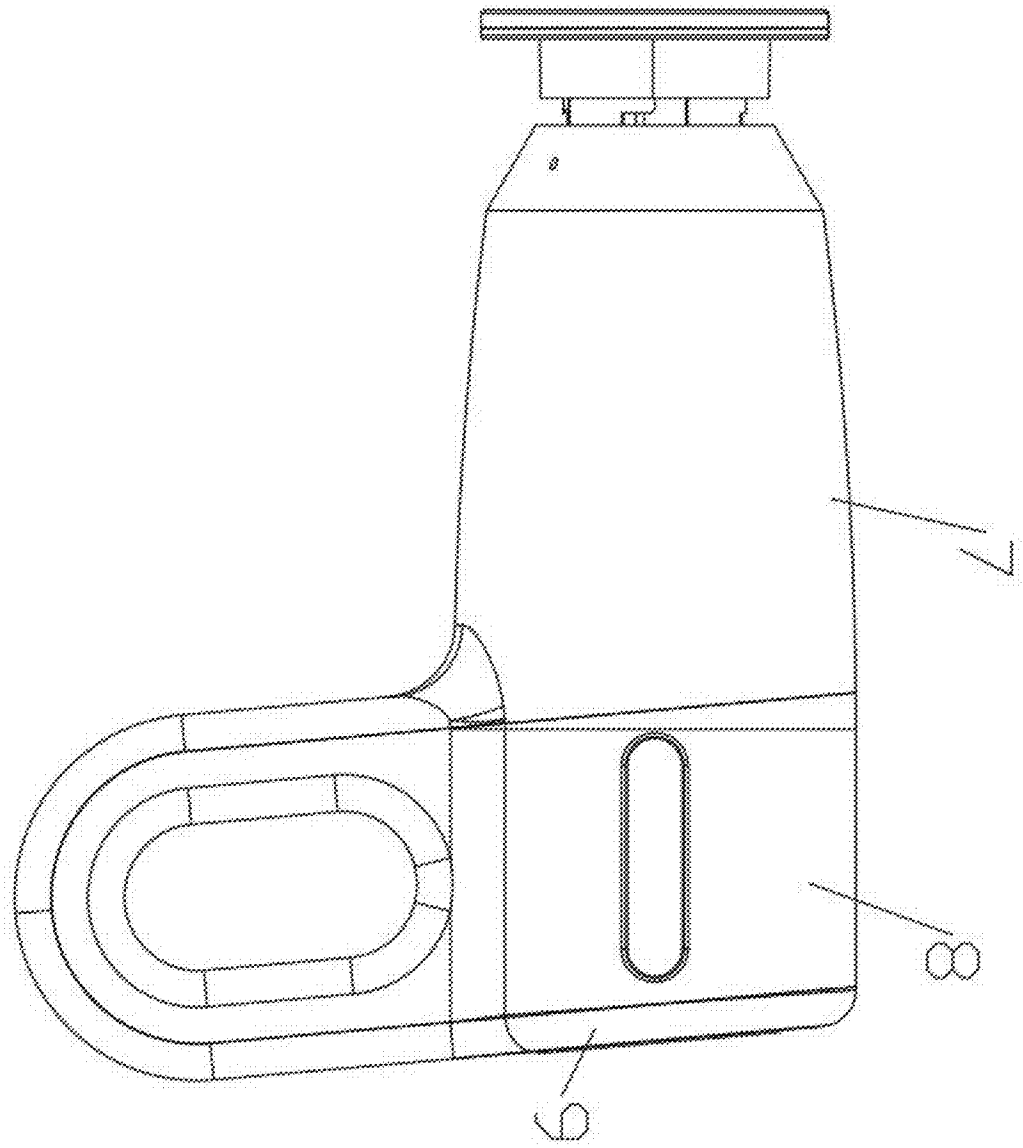
FIG. 1 is a side view of the forward and reverse cleaning brush with water spraying function, in an embodiment.
Figure 2:
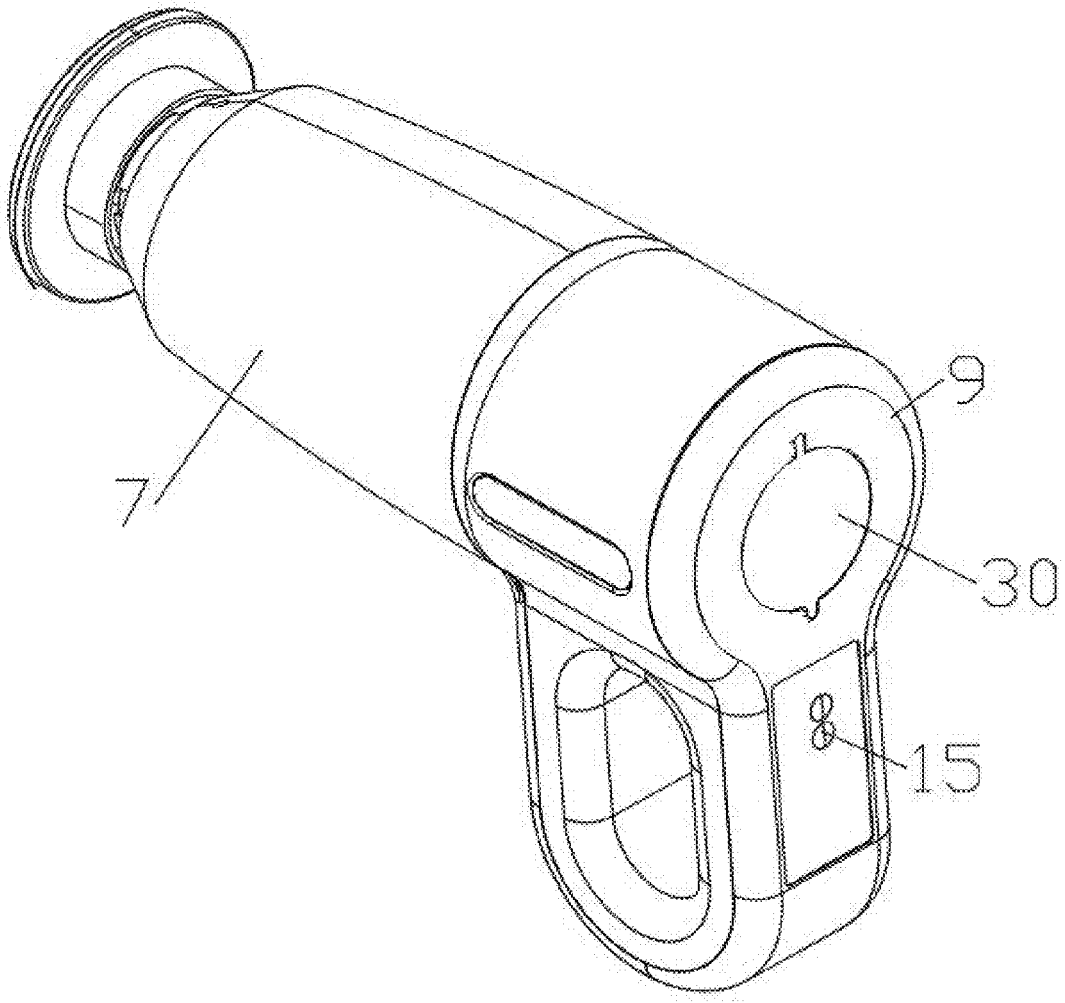
FIG. 2 is a rear perspective view of the forward and reverse cleaning brush with water spraying function, in an embodiment.
Figure 3:
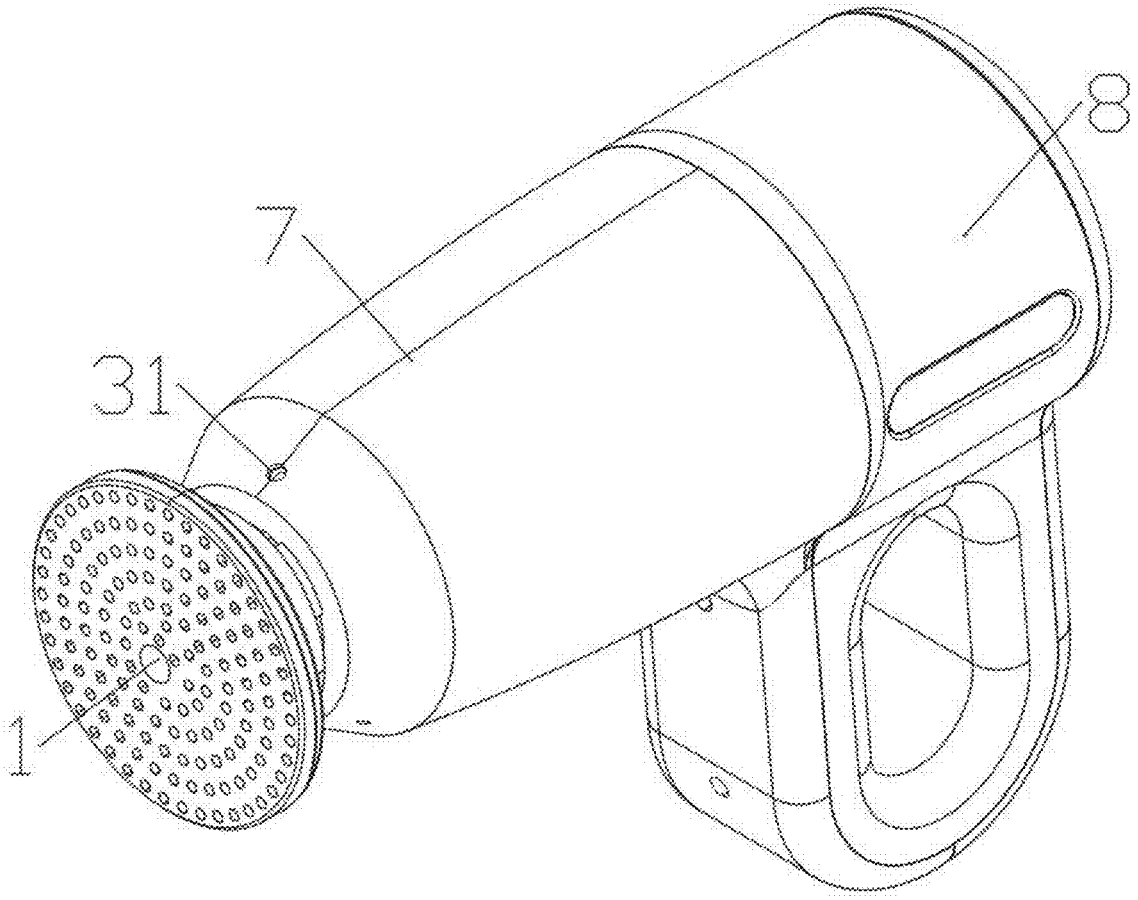
FIG. 3 is a front perspective view of the forward and reverse cleaning brush with water spraying function, in an embodiment.
Figure 4:
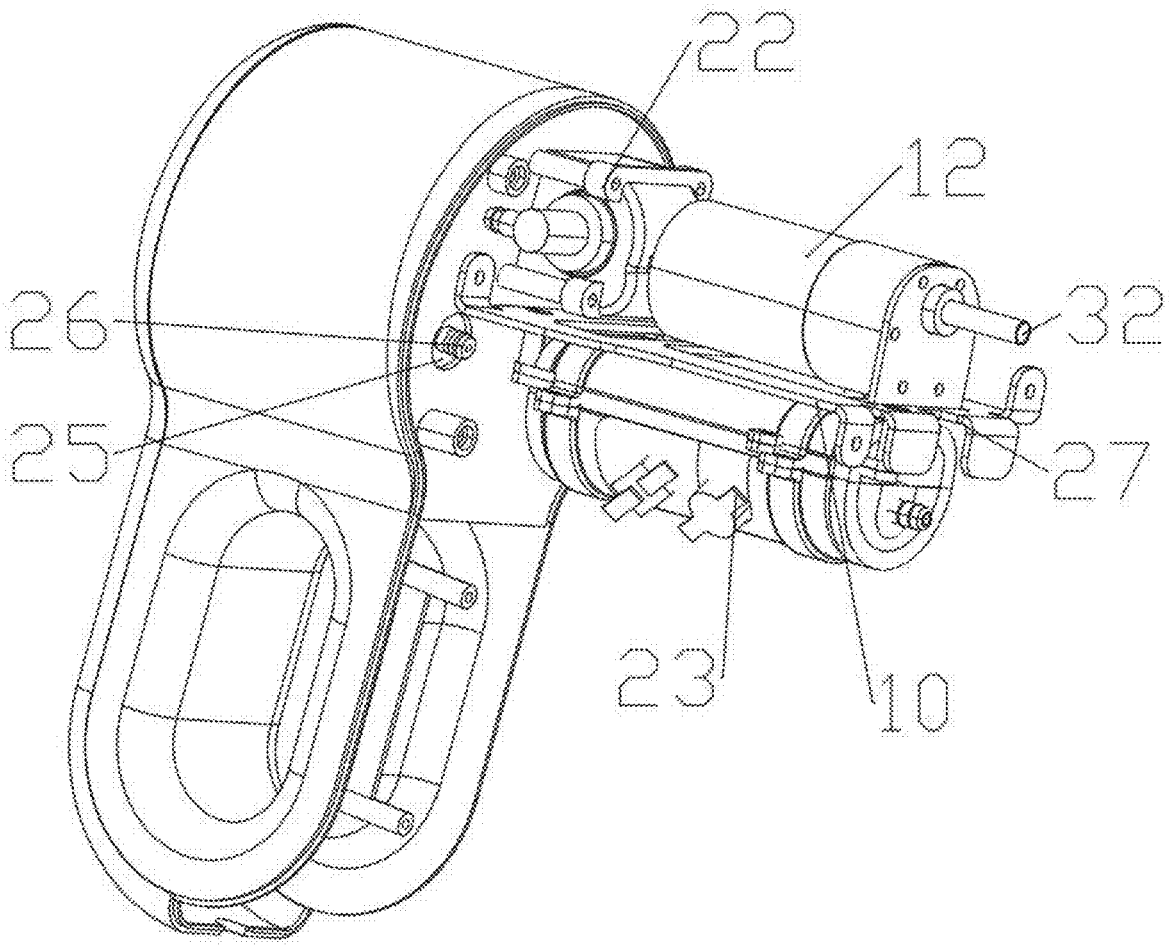
FIG. 4, is another perspective view of the forward and reverse cleaning brush with water spraying function in separate condition, in an embodiment.
Figure 5:
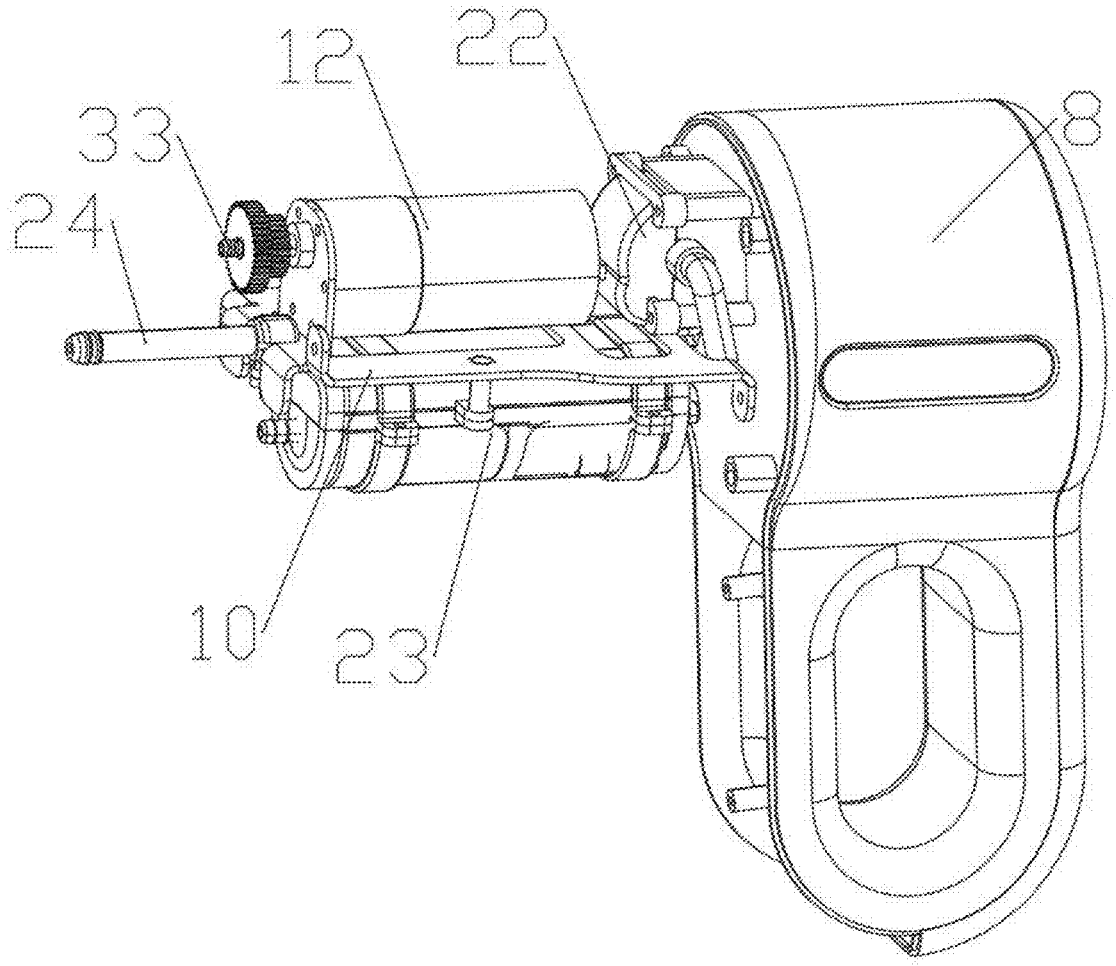
FIG. 5 is an inner view of the forward and reverse cleaning brush with water spraying function in separate condition, in an embodiment.
Figure 6:
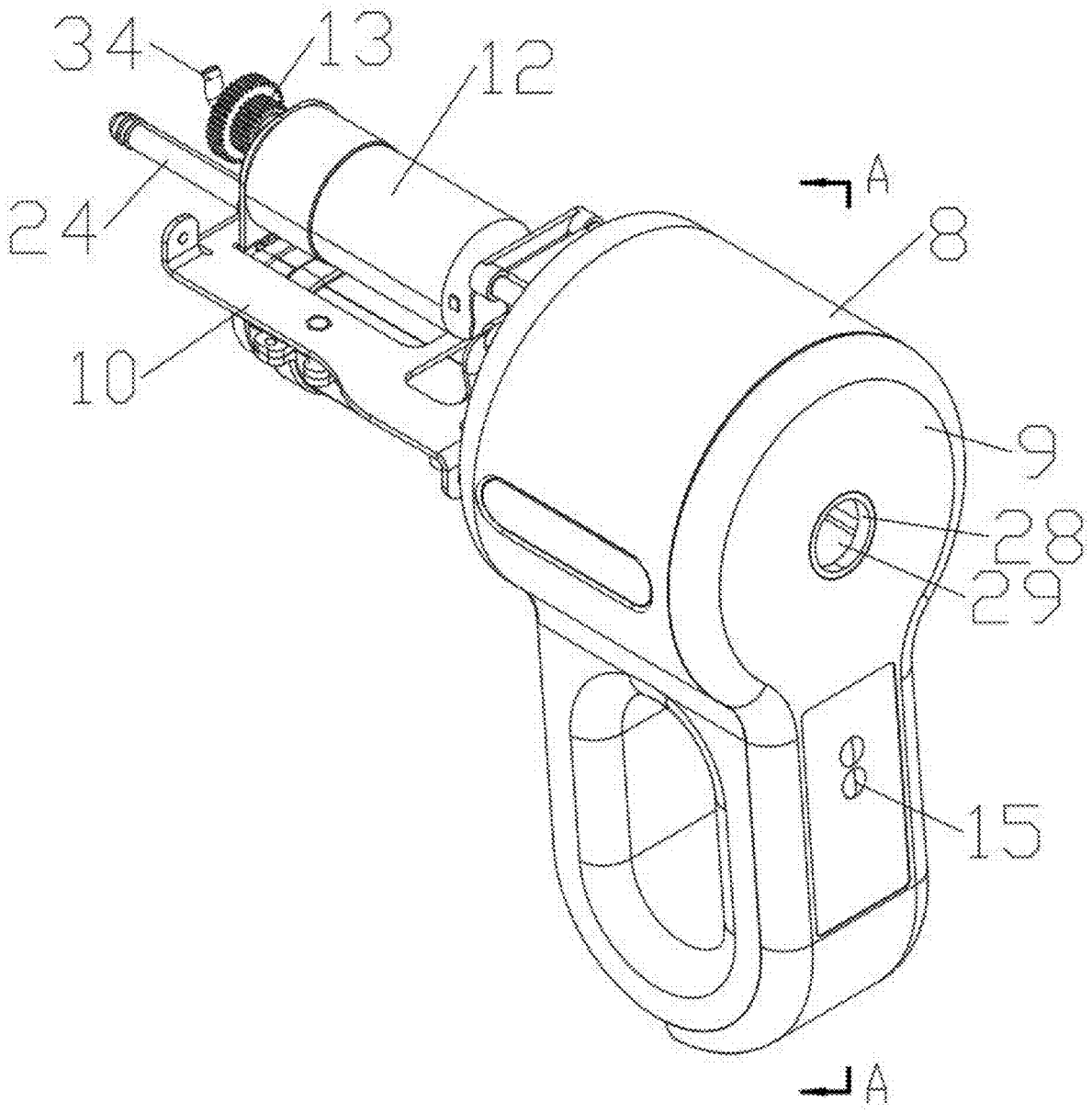
FIG. 6 is a rear perspective view of the forward and reverse cleaning brush with water spraying function in separate condition, in an embodiment.
Figure 7:
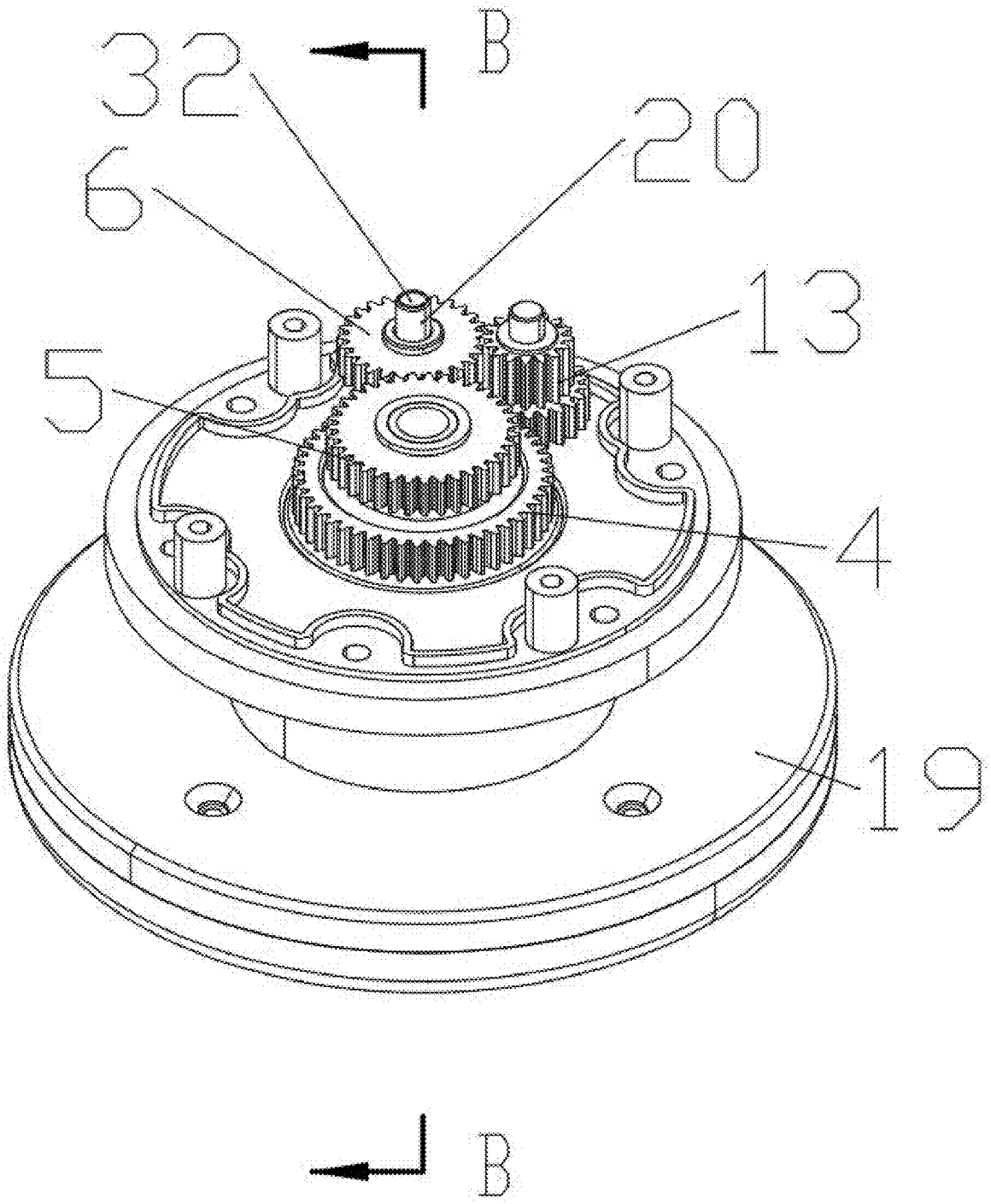
FIG. 7 is a perspective view of the cleaning brush plate, in an embodiment.
Figure 8:
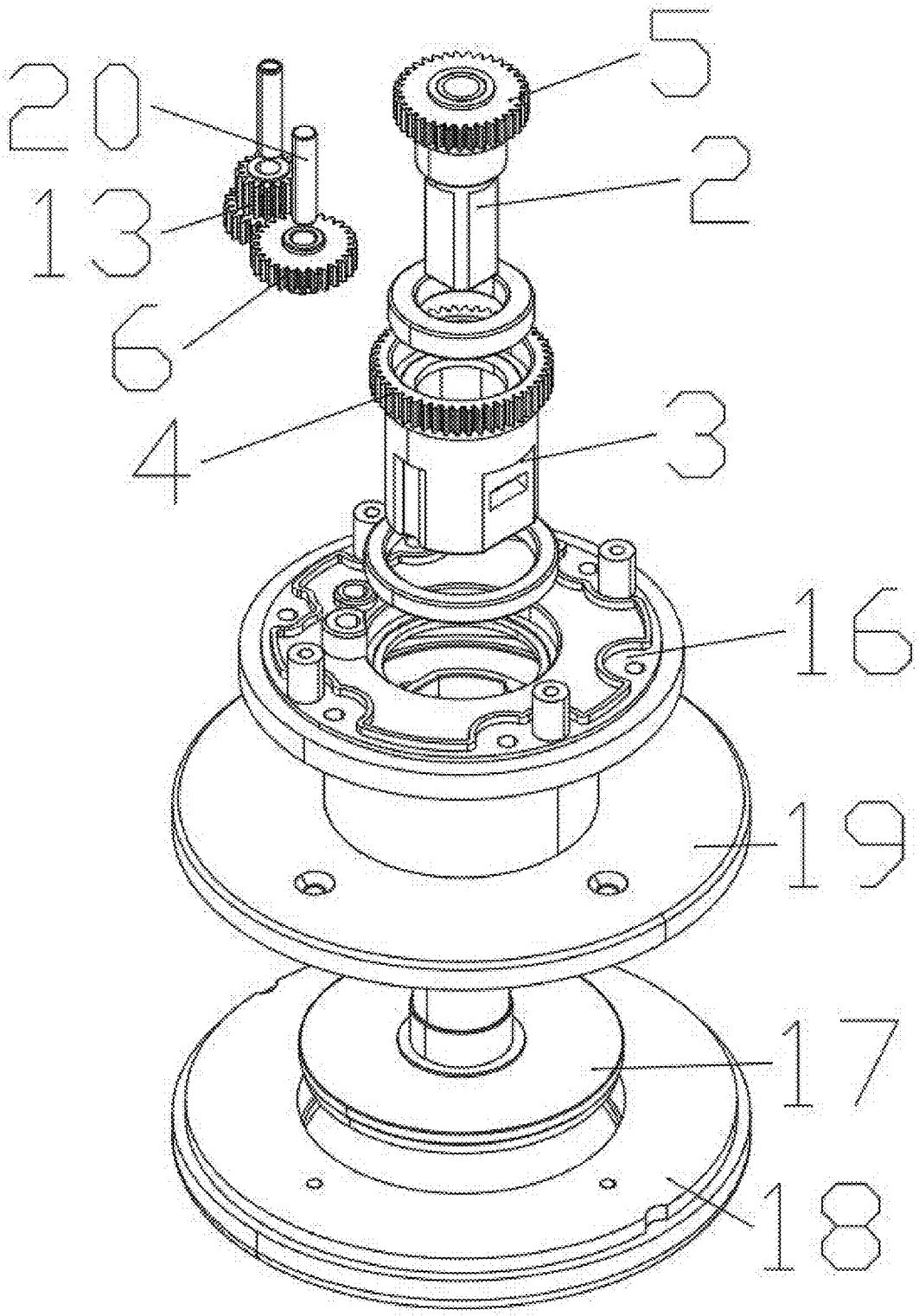
FIG. 8 is a perspective view of the cleaning brush plate in separate condition, in an embodiment.
Figure 9:
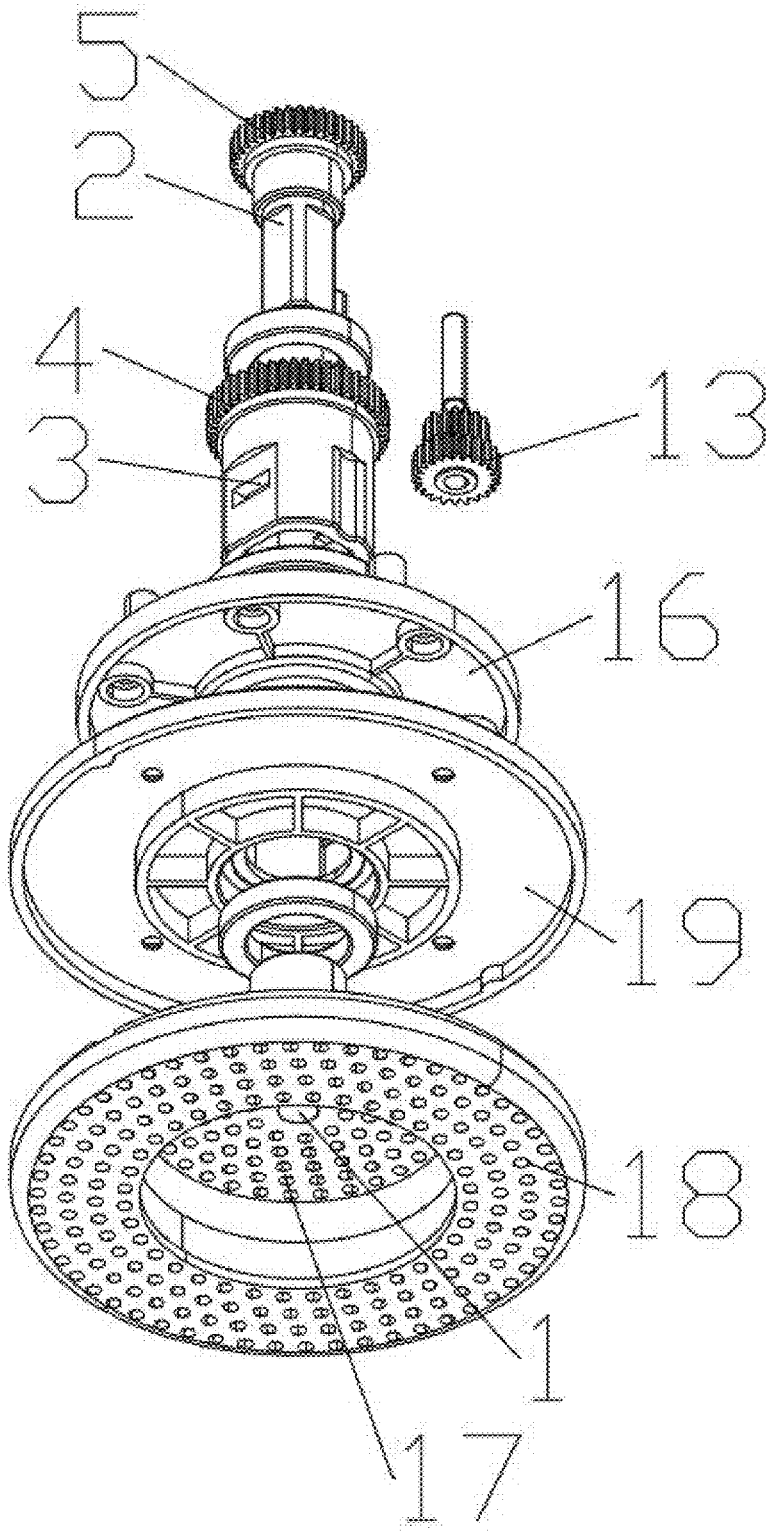
FIG. 9 is another perspective view of the cleaning brush plate in separate condition, in an embodiment.
Figure 10:
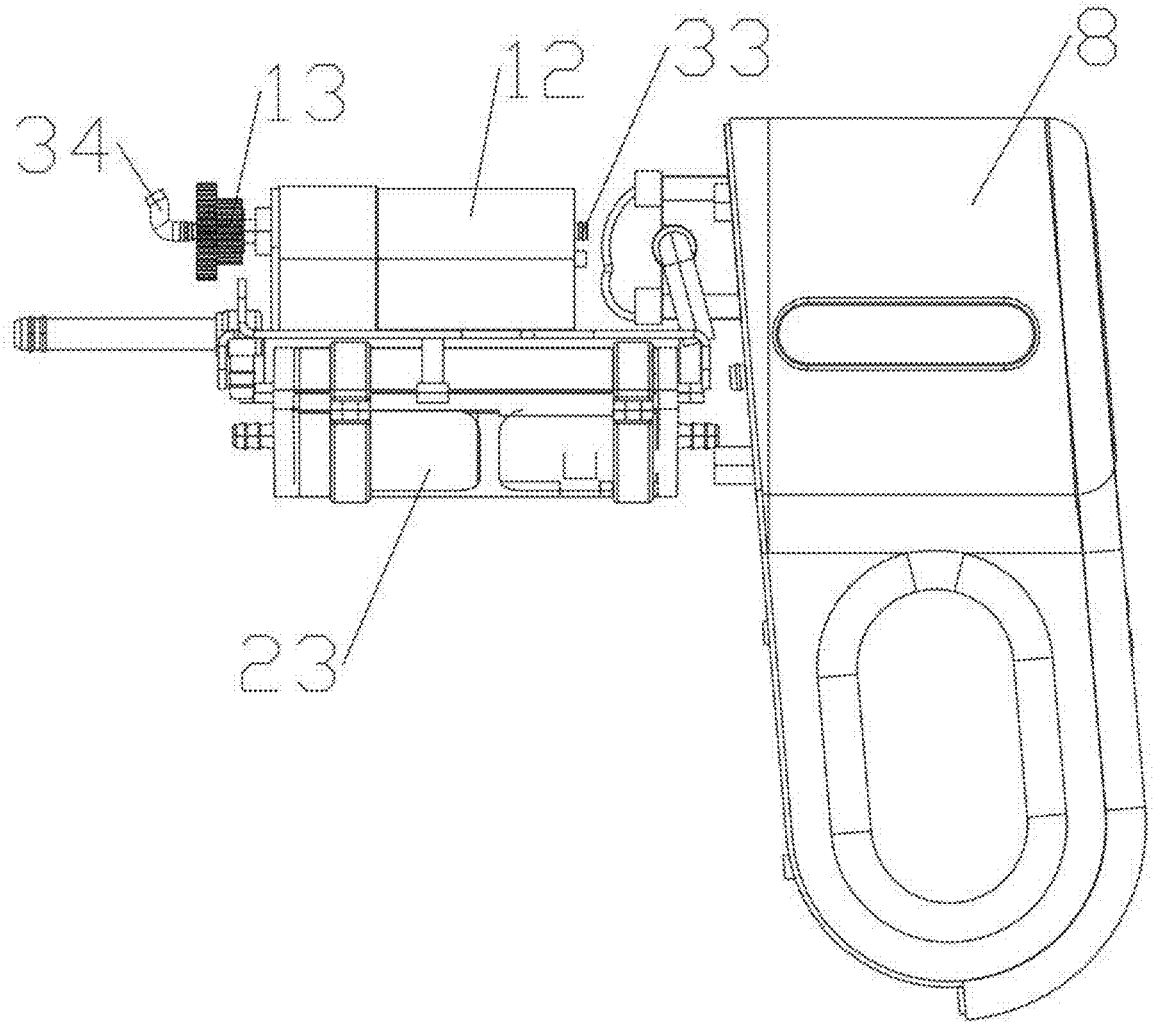
FIG. 10 is a side view of the transmission parts and cleaning brush plate in separate condition, in an embodiment.
Figure 11:
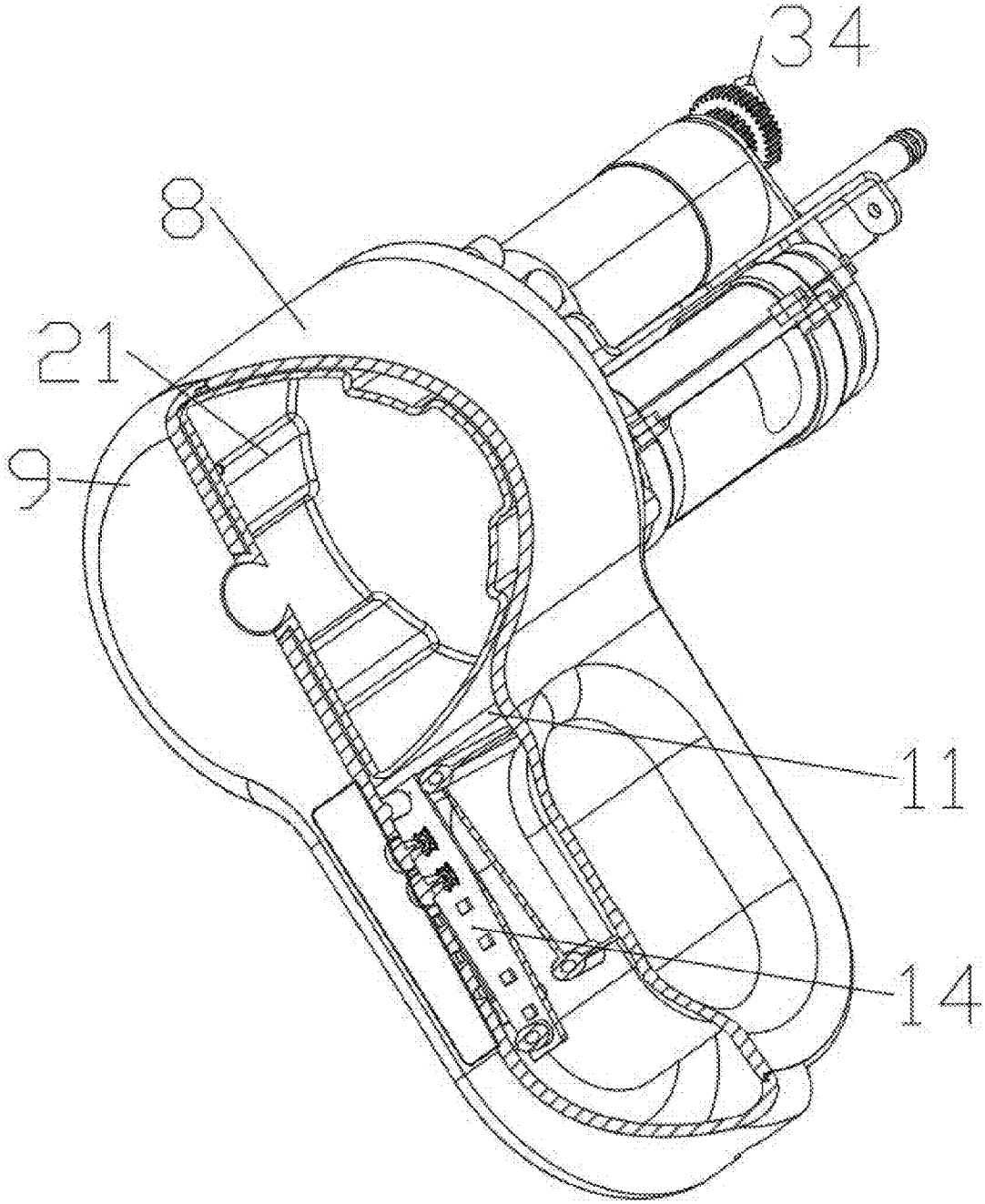
FIG. 11 is a cross-sectional view of A-A in FIG. 6.
Figure 12:
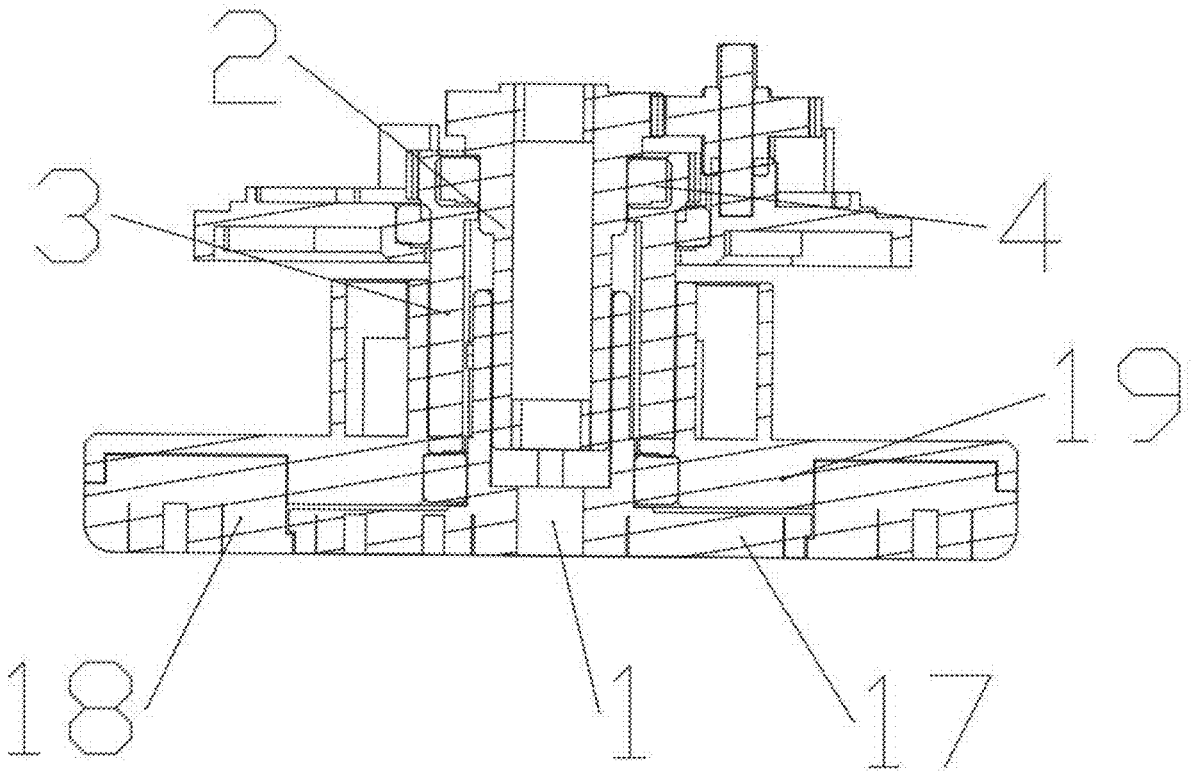
FIG. 12 is an enlarged view of portion B-B in FIG. 7.

As shown in FIGS. 1-12, a forward and reverse cleaning brush with water spraying function comprising:

a shell, a water spray heating mechanism, a power mechanism, a transmission component and a cleaning brush plate, wherein the water spray heating mechanism is arranged in the shell, the power mechanism is arranged in the shell, the transmission component is arranged at the front end of the shell, and the front end of the transmission component extends out of the shell, the cleaning brush plate is detachably arranged at the front end of the transmission component, the power mechanism and the transmission component cooperate to drive the cleaning brush plate to rotate to meet different cleaning needs, a first water outlet hole 1 penetrating the cleaning brush plate is provided in the middle of the cleaning brush plate, a second water outlet hole 31 is provided at the front end of the shell, and one end of the water spray heating mechanism passes through the transmission component and the power mechanism respectively and then extends to the first water outlet hole 1 and the second water outlet hole 31.

Which also comprising a control system disposed in the shell.

The transmission component includes a hollow inner rotating shaft 2, a hollow outer rotating shaft 3, a first driven gear 4, a second driven gear 5, and a transmission gear 6. A bearing is provided in the hollow outer rotating shaft 3, and the hollow inner rotating shaft 2 is arranged in the bearing. The hollow inner rotating shaft 2 and the hollow outer rotating shaft 3 are both connected and cooperated with the cleaning brush plate. The hollow outer rotating shaft 3 is extended from the rear end of the hollow inner rotating shaft 2, and the first driven gear 4 is provided at one end extending from the hollow outer rotating shaft 3. The second driven gear 5 is provided at the rear end of the hollow outer rotating shaft 3. The transmission gear 6 is rotatably arranged in the outer shell, and the transmission gear 6 is meshed with the first driven gear 4. The power mechanism is respectively meshed with the second driven gear 5 and the transmission gear 6 to drive the hollow inner rotating shaft 2 and the hollow outer rotating shaft 3 to rotate in different directions.

One end of the water spray heating mechanism passes through the hollow inner rotating shaft 2 and the power mechanism and then extends to the first water outlet hole 1 and the second water outlet hole 31.

The shell comprises a front shell 7, a rear shell 8, a tail cover 9, and a mounting frame 10. The rear end of the front shell 7 and the front end of the rear shell 8 are connected by bolts, and the rear end of the rear shell 8 and the tail cover 9 are connected by bolts. The mounting frame 10 is arranged in the front shell 7 and connected to the front shell 7 and the rear shell 8 by bolts. The second water outlet hole 31 is arranged at the front end of the front shell 7. The upper end of the rear shell 8 is provided with chamber 11.

The power mechanism includes a servo motor 12 and a double-layer driving gear 13. The servo motor 12 is arranged on the mounting frame 10. The double-layer driving gear 13 is arranged on the rotating shaft of the servo motor 12. The lower gear of the double-layer driving gear 13 is meshed with the second driven gear 5. The upper gear of the double-layer driving gear 13 cooperates with the transmission gear 6 to drive the hollow inner rotating shaft 2 and the hollow outer rotating shaft 3 to rotate in different directions. A through hole 32 is arranged in the rotating shaft of the servo motor 12. Bearings are respectively arranged at both ends of the through hole 32. One end of the water spray heating mechanism passes through the through hole 32 and extends to the second water outlet hole 31.

The control system includes a control panel 14 and a button 15. The control panel 14 is connected to the tail cover 9 by bolts. The tail cover 9 is provided with a button 15 that cooperates with the control panel 14. After receiving the instruction of the button 15, the operation of the servo motor 12, the water pump 22, and the micro electric heating tank 23 is controlled.

The cleaning brush plate includes a cleaning brush chassis 16, an inner brush plate 17, an outer brush plate 18 and a brush plate chassis 19. The front end of the front shell 7 is provided with a cleaning brush chassis 16, and a bearing is provided in the middle of the cleaning brush chassis 16. The hollow outer rotating shaft 3 is arranged in the bearing, and the brush plate chassis 19 is located below the cleaning brush chassis 16. The upper end of the brush plate chassis 19 is connected to the bottom of the hollow outer rotating shaft 3, and the outer brush plate 18 is snap-connected with the brush plate chassis 19. The upper end of the inner brush plate 17 passes through the brush plate chassis 19 and is connected to the hollow inner rotating shaft 2. A bearing is provided inside the lower end of the brush plate chassis 19, and the lower end of the inner brush plate 17 is arranged in the bearing The cleaning brush chassis 16 is provided with a cylinder 20, and the transmission gear 6 is rotatably arranged on the cylinder 20;

The lower end of the inner brush plate 17 is arranged in a circular shape, and the lower end of the outer brush plate 18 is arranged in a ring shape, and the lower end of the inner brush plate 17 is arranged at the center of the lower end of the outer brush plate 18;

The first water outlet 1 is arranged in the middle of the inner brush plate 17

The water spray heating mechanism includes a water storage tank 21, a water pump 22, a micro electric heater 23, a water spray pipe 24, and a water delivery pipe 33. The water storage tank 21 is arranged in chamber 11. The rear shell 8 is provided with a hole 25 connected to the front shell 7. The water storage tank 21 is provided with a drain pipe 26. One end of drain pipe 26 extends from the hole 25 to the front shell 7. The water pump 22 is arranged in the front shell 7 and is installed on the rear shell 8 by bolts. The drain pipe 26 is connected to the water inlet of the water pump 22 through a pipeline. The micro electric heater 23 is installed below the mounting frame 10 by bolts. The water outlet of the water pump 22 is connected to the water outlet of the micro electric heater 23 through a pipeline. The water inlet is connected, the water spray pipe 24 is arranged in the hollow inner rotating shaft 2, and the front end of the water spray pipe 24 is located in the first water outlet 1, the water outlet of the micro electric heater 23 is provided with a tee, two of the pipe openings of the tee are provided with hoses, the rear end of the water spray pipe 24 is connected to one of the hoses, the water delivery pipe 33 is arranged in the through hole 32 and placed in the bearing, the water delivery pipe 33 is rotatably connected with the through hole 32 through the bearing, so that when the rotating shaft of the servo motor 12 rotates, it will not affect the water delivery pipe 33, the rear end of the water delivery pipe 33 is connected to another hose, the other end of the water delivery pipe 33 is provided with a pipe body 34, and the other end of the pipe body 34 extends to the second water outlet hole 31.

Water can be pumped from the water storage tank 21 by the water pump 22, and then the water is transported to the micro electric heating tank 23, the micro electric heating tank 23 heats the water inside, and then sprays hot steam, which is sprayed through the water spray pipe 24 and the pipe body 34 and sprayed to the clean place, which can play a role in dust reduction on the one hand, and has a certain sterilization effect on the other hand; if the hot steam is not needed, the micro electric heating tank 23 can be turned off, so that the water will not be heated, and water can be sprayed from the water spray pipe 24 and the pipe body 34; secondly, the water storage tank 21 can also be filled with detergent according to the usage, so that the detergent can be sprayed when scrubbing;

The end of the water spray pipe 24 located in the first water outlet 1 is provided with a sealing ring, and the end of the pipe body 34 located in the second water outlet 31 is provided with a sealing ring to prevent water leakage. A limiting groove 27 is provided at the front end of the mounting frame 10, and the tail of the water spray pipe 24 is located in the limiting groove 27, which is used to limit the rotation of the water spray pipe 24. The middle and rear ends of the hollow inner rotating shaft 2 are provided with bearings, and the water spray pipe 24 is placed in the bearings; the bearings are used to support the water spray pipe 24, so that the water spray pipe 24 is placed in the center position of the hollow inner rotating shaft 2, and when the hollow inner rotating shaft 2 rotates, it will not affect the water spray pipe 24, thereby achieving the inner brush disc 17 and the outer brush disc 18 rotating to clean and spray water at the same time.

The water storage tank 21 is provided with a water supply pipe 28 at the rear end, and the rear shell 8 is provided with a water supply hole 29 at the rear end. The water supply pipe 28 is placed at the water supply hole 29, and a sealing cover 30 is provided on the water supply pipe 28.

In embodiment 1, when in use, the user first opens the sealing cover 30, then fills the water storage tank 21 with water, and closes the sealing cover 30 after it is full.

Then, the desired cleaning mode and water spray temperature are set through button 15; then, the equipment is started, and the servo motor 12 drives the cleaning brush disc to rotate. During rotation, the double-layer driving gear 13 drives the second driven gear 5 and the transmission gear 6 to rotate, and the transmission gear 6 drives the first driven gear 4 to rotate, thereby driving the hollow inner rotating shaft 2 to rotate, and the second driven gear 5 drives the hollow outer rotating shaft 3 to rotate, and the hollow inner rotating shaft 2 and the hollow outer rotating shaft 3 rotate in different directions, thereby driving the inner brush disc 17 and the outer brush disc 18 to rotate in different directions so that the inner brush disc 17 and the outer brush disc 18 rotate in a forward direction and a reverse direction, respectively, to better clean.

The water pump 22 pumps the water in the water storage tank 21 into the micro electric heating tank 23, which heats the water inside. The micro electric heating tank 23 sprays the heated steam to the surface to be cleaned through the water spray pipe 24 and the pipe body 34; during the cleaning process, the user can adjust the cleaning mode and the water spray temperature as needed. When heating is not required or the heating temperature is relatively low, water can be sprayed from the water spray pipe 24 and the pipe body 34.

During maintenance, the user can turn off the device and disconnect the power supply, then remove the tail cover 9 and the front shell 7 to inspect and clean the internal components. If you need to replace the cleaning brush plate, just remove the cleaning brush plate assembly.

In embodiment 2, when in use, the user first opens the sealing cover 30, then adds detergent to the water storage tank 21, and closes the sealing cover 30 after filling it up.

Then, the desired cleaning mode is set by pressing button 15; then, the device is started, and the servo motor 12 drives the cleaning brush plate to rotate.

When rotating, the double-layer driving gear 13 will drive the second driven gear 5 and the transmission gear 6 to rotate, the transmission gear 6 will drive the first driven gear 4 to rotate, and then drive the hollow inner rotating shaft 2 to rotate, and the second driven gear 5 will drive the hollow outer rotating shaft 3 to rotate, the hollow inner rotating shaft 2 and the hollow outer rotating shaft 3 rotate in different directions, and then drive the inner brush disc 17 and the outer brush disc 18 to rotate in different directions so that the inner brush disc 17 and the outer brush disc 18 can rotate one forward and one reverse, which can better clean.

The water pump 22 draws the detergent in the water storage tank 21 into the micro electric heating tank 23, and the detergent is sprayed out to the surface to be cleaned through the water spray pipe 24 and the pipe body 34 through the micro electric heating tank 23; please note that when using the detergent, it is not necessary to heat it.

What is claimed is:

1. A forward and reverse cleaning brush with water spraying function, comprising a shell, a water spray heating mechanism, a power mechanism, a transmission component and a cleaning brush plate, wherein the water spray heating mechanism is arranged in the shell, the power mechanism is arranged in the shell, the transmission component is arranged at a front end of the shell, and a front end of the transmission component extends out of the shell, the cleaning brush plate is detachably arranged at the front end of the transmission component, the power mechanism and the transmission component cooperate to drive the cleaning brush plate to rotate, a first water outlet hole penetrating the cleaning brush plate is arranged in a middle part of the cleaning brush plate, one end of the water spray heating mechanism passes through the transmission component and extends to the first water outlet hole, a second water outlet hole is arranged at the front end of the shell, one end of the water spray heating mechanism passes through the transmission component and the power mechanism and extends to the first water outlet hole and the second water outlet hole respectively;

which also comprising a control system disposed in the shell;

wherein the transmission component includes a hollow inner rotating shaft, a hollow outer rotating shaft, a first driven gear, a second driven gear and a transmission gear; wherein a bearing is provided in the hollow outer rotating shaft, and the hollow inner rotating shaft is arranged in the bearing; the hollow inner rotating shaft and the hollow outer rotating shaft are both connected and cooperated with the cleaning brush plate; the hollow outer rotating shaft is extended from a rear end of the hollow inner rotating shaft, and the first driven gear is provided at one end extending from the hollow outer rotating shaft; wherein the second driven gear is provided at a rear end of the hollow outer rotating shaft; the transmission gear is rotatably arranged in the outer shell, and the transmission gear is meshed with the first driven gear; the power mechanism is respectively meshed with the second driven gear and the transmission gear to drive the hollow inner rotating shaft and the hollow outer rotating shaft to rotate in different directions;

wherein one end of the water spray heating mechanism passes through the hollow inner rotating shaft and the power mechanism and then extends to the first water outlet and the second water outlet.

2. The forward and reverse cleaning brush with water spraying function of claim 1, wherein the shell comprises a front shell, a rear shell, a tail cover and a mounting frame, wherein a rear end of the front shell and a front end of the rear shell are connected by bolts, the rear end of the rear shell and the tail cover are connected by bolts, the mounting frame is arranged in the front shell and connected to the front shell and the rear shell by bolts, the second water outlet is arranged at the front end of the front shell, and a chamber is arranged at the upper end of the rear shell.

3. The forward and reverse cleaning brush with water spraying function of claim 2, wherein the power mechanism includes a servo motor and a double-layer driving gear; the servo motor is arranged on a mounting frame; the double-layer driving gear is arranged on a rotating shaft of the servo motor; a lower gear of the double-layer driving gear is meshed with the second driven gear; wherein an upper gear of the double-layer driving gear cooperates with the transmission gear to drive the hollow inner rotating shaft and the hollow outer rotating shaft to rotate in different directions; a through hole is arranged in the rotating shaft of the servo motor; wherein the bearings are arranged at both ends of the through hole; one end of the water spray heating mechanism passes through the through hole and extends to the second water outlet.

4. The forward and reverse cleaning brush with water spraying function of claim 2, wherein the control system includes a control panel and buttons; the control panel is connected to the tail cover by bolts; the tail cover is provided with buttons that match the control panel.

5. The forward and reverse cleaning brush with water spraying function of claim 2, wherein the cleaning brush plate comprises a cleaning brush chassis, an inner brush shell, an outer brush shell and a brush shell chassis, the front end of the front shell is provided with a cleaning brush chassis, the middle part of the cleaning brush chassis is provided with a bearing, the hollow outer rotating shaft is arranged in the bearing, the brush shell chassis is located below the cleaning brush chassis, the upper end of the brush shell chassis is connected with the bottom of the hollow outer rotating shaft, the outer brush shell is snap-connected with the brush shell chassis, the upper end of the inner brush shell passes through the brush shell chassis and is connected with the hollow inner rotating shaft, a bearing is arranged inside the lower end of the brush shell chassis, and the lower end of the inner brush shell is arranged in the bearing;

wherein the cleaning brush chassis is provided with a cylinder, and the transmission gear is rotatably arranged on the cylinder;

the lower end of the inner brush shell is arranged in a circular shape, the lower end of the outer brush shell is arranged in a ring shape, and the lower end of the inner brush shell is arranged at the center of the lower end of the outer brush shell;

the first water outlet is arranged in the middle of the inner brush shell.

6. The forward and reverse cleaning brush with water spraying function of claim 5, wherein the water spray heating mechanism includes a water storage tank, a water pump, a micro-electric heater, a water spray pipe, and a water delivery pipe; the water storage tank is arranged in the chamber; the rear shell is provided with a hole connected to the front shell; the water storage tank is supplied with a drain pipe, one end of the drain pipe extends from the hole into the front shell; wherein the water pump is arranged in the front shell and is installed on the rear shell by bolts; a pipeline connects the drain pipe to the water pump's inlet; the micro-electric heater is installed below the mounting frame by bolts; the water outlet of the water pump is connected to the water inlet of the micro-electric heater through a pipeline; the water spray pipe is arranged in the hollow inner rotating shaft, and the front end of the water spray pipe is located in the first water outlet hole; the water outlet of the micro electric heater is provided with a tee, two of the pipe openings of the tee are provided with hoses, the rear end of the water spray pipe is connected to one of the hoses, the water delivery pipe is arranged in the through hole and placed in the bearing, the rear end of the water delivery pipe is connected to the other hose, the other end of the water delivery pipe is provided with a pipe body, and the other end of the pipe body extends to the second water outlet hole.

7. The forward and reverse cleaning brush with water spraying function of claim 6, wherein the end of the water spray pipe located in the first water outlet is provided with a sealing ring, the end of the pipe body located in the second water outlet is provided with a sealing ring, the front end of the mounting frame is provided with a limiting groove, the tail of the water spray pipe is located in the limiting groove, which is used to limit the rotation of the water spray pipe, the middle part and the rear end of the hollow inner rotating shaft are both provided with bearings, and the water spray pipe is placed in the bearing.

8. The forward and reverse cleaning brush with water spraying function of claim 6, wherein the water tank is provided with a water adding pipe at the rear end, the rear shell is provided with a water adding hole at the rear end, the water adding pipe is placed at the water adding hole, and a sealing cover is provided on the water adding pipe.

* * * * *